US006685148B2

(12) United States Patent
Zadok

(10) Patent No.: US 6,685,148 B2
(45) Date of Patent: Feb. 3, 2004

(54) SUPPORT FOR HAND HELD VIDEO CAMERA

(76) Inventor: Adam Zadok, 31229 Rivoll Rd., Valley Center, CA (US) 92082

( * ) Notice: Subject to any disclaimer, the term of this patent is extended or adjusted under 35 U.S.C. 154(b) by 0 days.

(21) Appl. No.: 10/131,764

(22) Filed: Apr. 24, 2002

(65) Prior Publication Data

US 2003/0201371 A1 Oct. 30, 2003

(51) Int. Cl.[7] ..... F16M 11/04

(52) U.S. Cl. ..... 248/187.1; 248/177.1; 396/421; 352/243

(58) Field of Search ..... 248/276.1, 187.1, 248/177.1, 178.1, 291.1, 292.12, 280.11; 396/428, 420, 422, 423, 425, 12, 180, 419, 5, 437; 362/2; 224/265; 348/373, 375; 352/171, 243

(56) References Cited

U.S. PATENT DOCUMENTS

| | | | | | |
|---|---|---|---|---|---|
| 4,044,364 | A | * | 8/1977 | Prinzo | 354/74 |
| 4,187,021 | A | | 2/1980 | Balser | 354/293 |
| 4,233,634 | A | * | 11/1980 | Adams | 358/229 |
| 4,283,135 | A | | 8/1981 | Lupis | 354/293 |
| 4,569,579 | A | | 2/1986 | Kangas | 354/293 |
| 5,908,181 | A | * | 6/1999 | Valles-Navarro | 248/177.1 |
| 6,030,130 | A | | 2/2000 | Paddock et al. | 396/421 |
| 6,056,449 | A | * | 5/2000 | Hart | 396/421 |

FOREIGN PATENT DOCUMENTS

| | | |
|---|---|---|
| DE | 195 19 528 A1 | 11/1996 |
| FR | 2 793 870 | 11/2000 |
| GB | 2 325 393 | 11/1998 |
| WO | WO 96/154404 | 5/1996 |

* cited by examiner

*Primary Examiner*—Gwendolyn Baxter
(74) *Attorney, Agent, or Firm*—Freling E. Baker; Brown Martin Haller & McClaim

(57) ABSTRACT

A hand held support for hand held cameras includes a first frame having a hand grip and a pivot mount spaced from the hand grip; a second frame pivotally mounted to the first frame at the pivot mount, and a camera mount on the second frame disposed below the pivot mount and adjustable to position the center of gravity of the camera relative to the pivot so that the camera remains in the desired level orientation upon pivoting of the support. An additional feature included adjustable weights on the frame and alternatively on the camera to adjust the center of gravity of the camera relative to the pivot axis of the inner frame.

17 Claims, 7 Drawing Sheets

SUPPORT FOR HAND HELD VIDEO CAMERA

REFERENCE TO RELATED APPLICATIONS

The present application is related to Applicant's U.S. Ser. No. 09/923,467, "STABILIZING HOLDER FOR HAND HELD CAMERA" filed Aug. 6, 2001; and Ser. No. 09/954,917, entitled "SUPPORT FOR HAND HELD CAMERA" filed Sep. 17, 2001.

BACKGROUND OF THE INVENTION

The present invention relates generally to the field of operator carried camera supports and pertains particularly to an improved camera support for hand held cameras.

Camera movement by an operator has an important role in the quality of video taping and moving pictures. Smoothness of movement of the camera on its support and movement of the support by the operator is important for the quality of the film. It is difficult for an individual to hold a hand held movie or video camera reasonably steady and move it smoothly while filming a typical moving target. This is difficult whether the operator is moving or standing still and is particularly difficult when both the target and operator are moving. It is particularly difficult for the average person to get good pictures while walking, running or climbing stairs during filming of a moving target. This difficulty in holding hand held movie and video cameras steady often results in blurry, jerky and unstable pictures.

The motions of a camera for aiming it during shooting of scenes are referred to as pan, tilt and roll. As used in the art and herein, "pan" is a movement of the camera about a vertical axis generally along its vertical support axis. "Tilt" identifies a motion about a horizontal axis that is at a right angle or 90 degrees to the axis of the lens. Finally, "roll" means rotation about an axis parallel to the lens axis.

Some attempts have been made in the past to provide means for steadying a movie or video camera while both the subject and operator are moving. These attempts have been largely directed to large commercial cameras and involve providing expensive systems including a large harness with a spring supported camera support frame. These are unsuitable for the average consumer. The inventor has developed and discloses in co-pending applications Ser. No. 09/923,467, filed Aug. 6, 2001; and Ser. No. 09/954,917, filed Sep. 17, 2001 supports that overcome many of the problems of the prior art for personal cameras for the average consumer. However, these devices have some drawbacks to which the present invention is directed. Among the drawback are that the camera tends to swing too easily and at excessive amplitude at times.

There is an evident need for an improved stabilizing support for personal hand held cameras.

SUMMARY AND OBJECTS OF THE INVENTION

It is the primary object of the present invention to provide a stabilizing support for personal hand held movie cameras that overcome the above problems of the prior art.

In accordance with a primary aspect of the present invention, a hand held movie camera comprises a first frame having a hand grip and at least one pivot mount spaced from said hand grip, a second frame pivotally mounted to said first frame at said pivot mount, and a camera mount on said second frame member disposed below said pivot mount so that the camera swings free of the support in at least one direction.

BRIEF DESCRIPTION OF THE DRAWINGS

The above and other objects and advantages of the present invention will become apparent from the following description when read in conjunction with the accompanying drawings wherein.

DETAILED DESCRIPTION OF PREFERRED EMBODIMENTS

The present invention provides an apparatus for solving the aforementioned problems of the prior art by providing a camera support for isolating the camera from certain input motions of the operator. This is carried out in one embodiment by means of a support apparatus for a hand held movie camera which comprises a first or outer frame having a hand grip and at least one pivot mount spaced from the hand grip, a second frame pivotally mounted to the first frame on the pivot mount, and a camera mount on the second frame adjustably position able below the pivot mount so that the camera swings free of certain movements of the first frame. The camera maintains a substantially level condition regardless of the orientation, within limits, of the base or outer frame.

Figure 1:
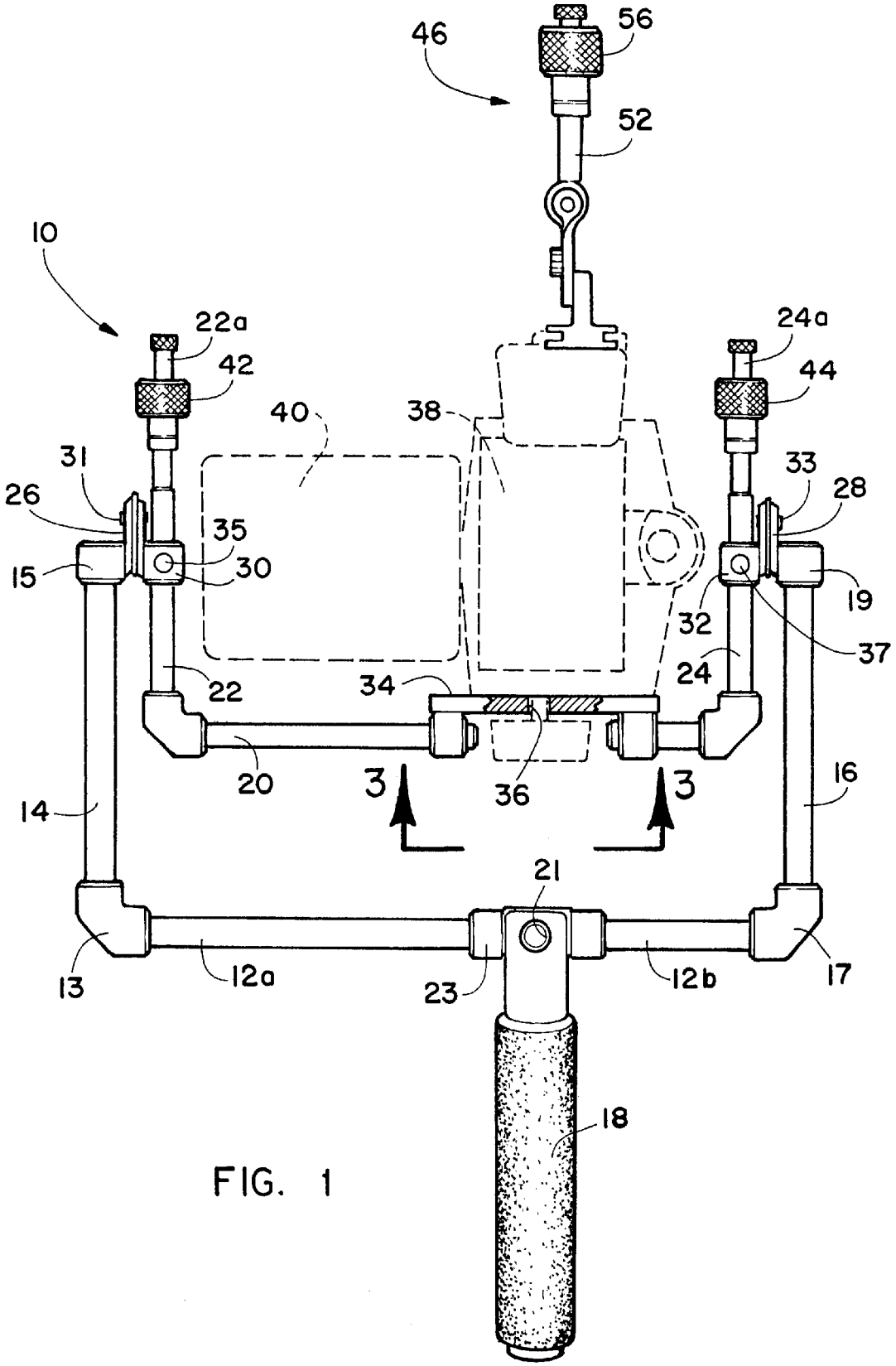
FIG. 1 is rear elevation view of a first exemplary embodiment of the present invention.
Figure 2:
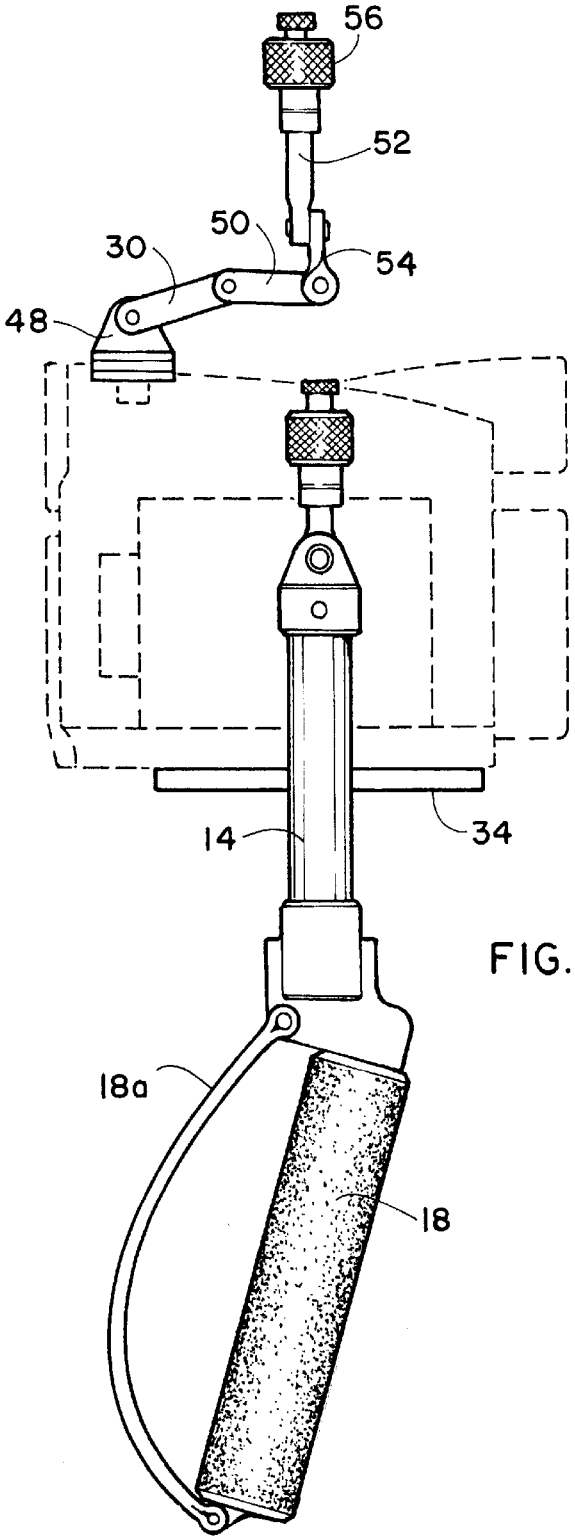
FIG. 2 is a side elevation view of the embodiment of FIG. 1.

Referring now more specifically to the drawings, and particularly to FIGS. 1 and 2, one embodiment of a hand held support for a hand held camera is illustrated and designated generally by the numeral 10. The camera support is viewed from the rear of a camera and comprises a base first or outer frame 12 having a generally U configuration with an elongated generally horizontal central bar 12, and a pair of generally laterally spaced arms 14 and 16 extending generally at a right angle to horizontal central bar 12. These arms are shown extending vertically upward in FIG. 1. Central bar 12 extends generally horizontally in normal operation and a handgrip 18 is secured between the ends thereof and extends generally downwardly. The illustrated hand grip is of a generally conventional design and for ease of gripping and holding extends downwardly and forwardly as seen in FIG. 2. The support is designed to be preferably held generally vertically as illustrated in FIG. 1 with the camera above the handgrip in normal operation. However, it may be held forward of or below the handgrip for lower angle shots.

A second or inner generally U shaped frame comprises an elongated generally horizontal central bar 20, and a pair of laterally spaced arms 22 and 24 extending generally at a right angle to horizontal central bar 20. Inner frame 20, 22, 24 is pivotally mounted to the first frame by means of pivot brackets 26 and 28 on the outer ends of arms 24 and 16 and a pair of inner pivot brackets 30 and 32 adjustably mounted on arms 22 and 24. The pivot brackets form a hinge and pivot about pin 31 attaching the brackets 26 and 30 and pin 33 attaching brackets 28 and 32 together. Another aspect of the construction as illustrated is that it is modular in design allowing for quick and inexpensive product changes simply by changing the length of the linkages to accommodate different size cameras. Frame members 12*a*, 12*b*, 14, 16 are preferably constructed of light weight aluminum or other alloy extrusions and assembled into connectors 13, 15, 17, 19 and 23 by any suitable means such as pins, screws, glue or other adhesive. The remaining frames of the assemblies are similarly constructed.

Figure 3:
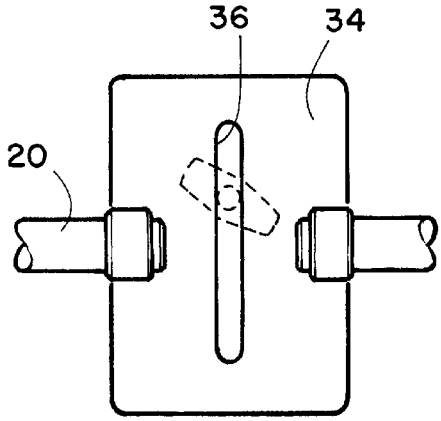
FIG. 3 is a view taken on line 3—3 of FIG. 1.

The inner frame is formed with a camera mounting platform 34 disposed between the ends thereof, for detachably mounting a camera to the frame. Platform 34 as shown in FIG. 3 includes an elongated slot 36 through which a thumb screw extends to mount a camera 38 shown in phantom. This slot enables the camera to be moved fore and aft on the platform and relative to the inner frame pivot axis.

The platform is positioned to one side of the center of the frame to accommodate a flip out screen common on most video cameras today. The profile of a Canon Model MV300i is illustrated in place on the platform. Hand grip 18 is preferably selectively mounted at a balance point along central bar 12 to balance the weight of the camera centrally above it. The hand grip is preferably mounted under the center of gravity and may be directly under the camera or to one side as necessary to affect the balance.

The pivot brackets 30 and 32 are designed to be adjustable along the arms 22 and 24 of the inner frame to adjust center of gravity or mass of the combined camera and inner frame relative to the pivot axis of the inner frame on the outer frame. The arms 22 and 24 slide in bores in brackets 30 and 32 and are clamped in any selected position such as by a thumb screws 35 and 37 or other suitable means. This adjusts the freedom or ease of movement of the inner frame relative to the outer frame as will be discussed. The pivot mount between the inner and outer frames is preferably positioned slightly above the center of gravity or mass of the combined camera and inner frame. The distance of the center of gravity from the pivot axis of the inner frame is preferably of a value to enable the inner frame to pivot under gravity, but avoid a pendulum effect. This can be as small as one to two millimeters up to between two and three centimeters. This adjustment capability enables a support as described to accommodate several different sizes and models of cameras.

The illustrated camera support is provided with additional center of gravity adjusting means in the form of adjustable position weights 42 and 44 mounted on threaded extensions 22*a* and 24*a* of arms 22 and 24. These allow further adjustment and fine tuning of the position of center of gravity of the inner frame and any camera mounted thereon. As these weights are moved in or out along the arm extensions, they move the center of gravity or mass of the combined camera and inner frame assembly up or down relative the pivot axis. The extensions 22 and 24*a* also serve as control levers to enable an operator to grasp one by the hand and tilt a camera up or down on its mount.

A weight adjusting attachment designated generally at 46 is detachably attachable to a camera and enables further adjustment in the position of the center of mass of the inner frame assembly. This attachment device comprises a base or shoe 48 that fits or mounts in an attachment slot in a top portion of a typical camera. An adjustable arm is formed of links 50 that attach to the shoe and has a threaded shaft 53 connected by a pivoting bracket 54 at the outer end thereof. A weight 56 is mounted on shaft 53 and moveable thereon to selectively position the weight relative to the shoe in a number of selected directions. The links 50 of the arm can be positioned to position the weight fore and aft of the pivot point or axis of the inner frame or up and down relative thereto.

Figure 4:
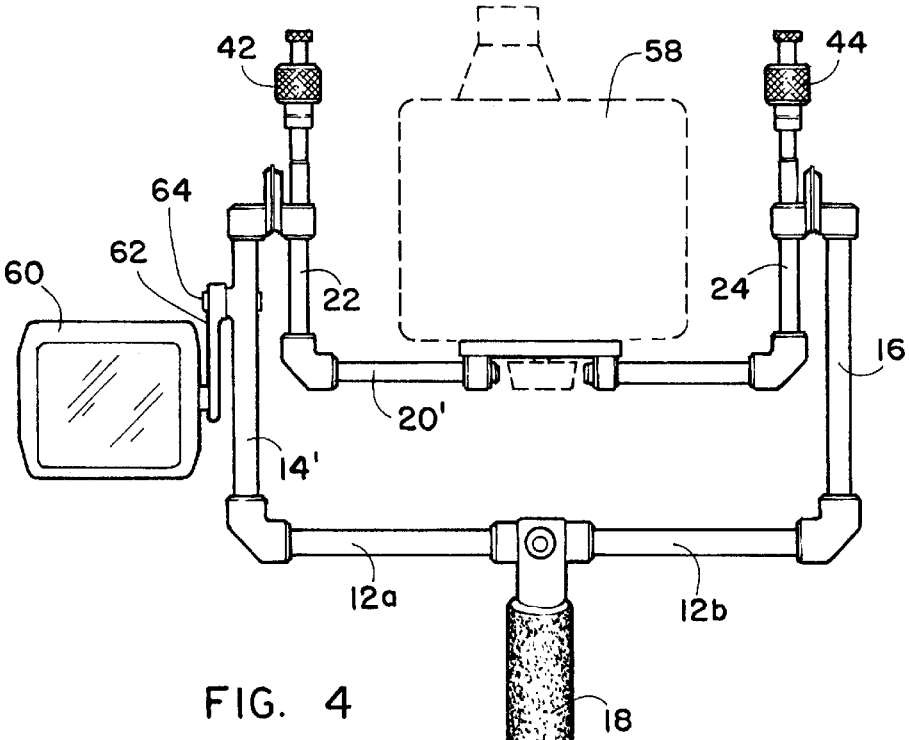
FIG. 4 is a rear elevation view of an alternate embodiment of the invention.
Figure 5:
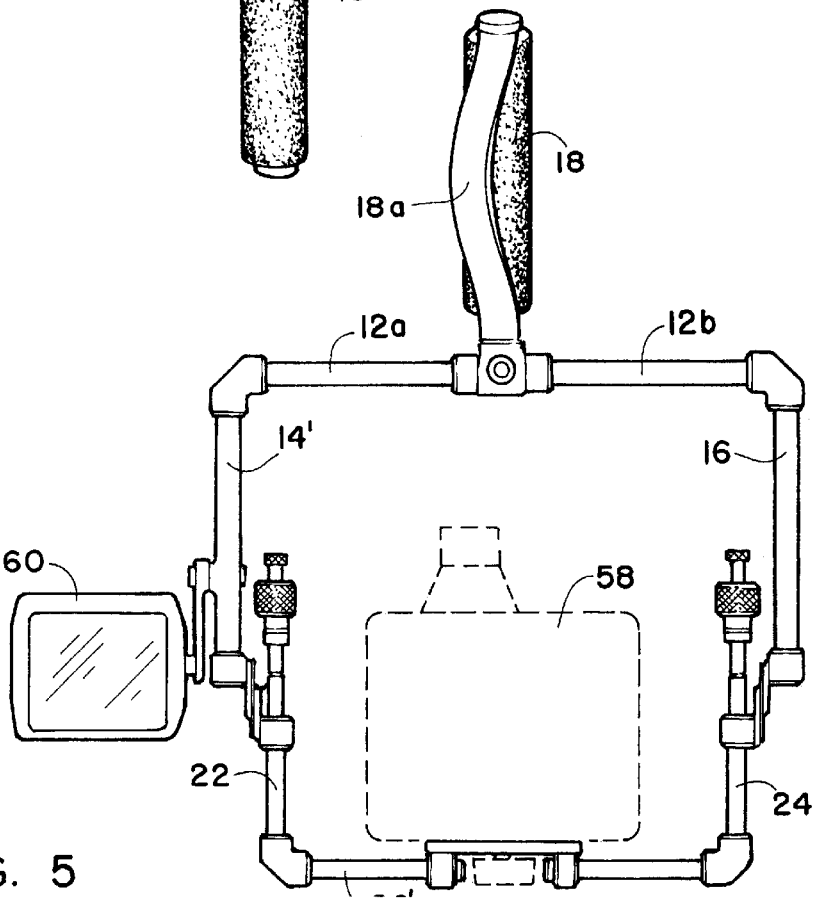
FIG. 5 is a rear elevation view of the embodiment of FIG. 4 in a lowered position of operation.

FIGS. 4 and 5 illustrate an alternate embodiment of the invention wherein the same elements are identified by the same reference numbers and modified elements are identified the same number primed. This embodiment is designed to accommodate larger cameras wherein a monitoring screen is located remote from the camera. As illustrated the overall support is substantially the same as the prior support with the inner frame having a horizontal bar 20' modified to position a camera mounting platform 34 substantially in the center thereof to accommodate a larger camera such as a CANON GL1. The camera has a remote monitoring screen 60, which in this embodiment is mounted on an arm 62 that is pivotally mounted on a pivot pin 64 on arm 14' of the outer frame. As shown, the camera is mounted in the center of the frame for ease of balancing.

The center of gravity of the camera may be selectively adjusted relative to the pivot axis of the inner frame as in the prior embodiment. The camera will swing with the inner frame and remain level as the main frame is moved or pivoted fore and aft. The camera can thus, be moved from or between upper positions as shown in FIG. 4 to lower positions as shown in FIG. 5. Strap 18*a* on the hand grip prevents the grip from slipping from the hand when in the down position as shown in FIG. 5.

Figure 6:
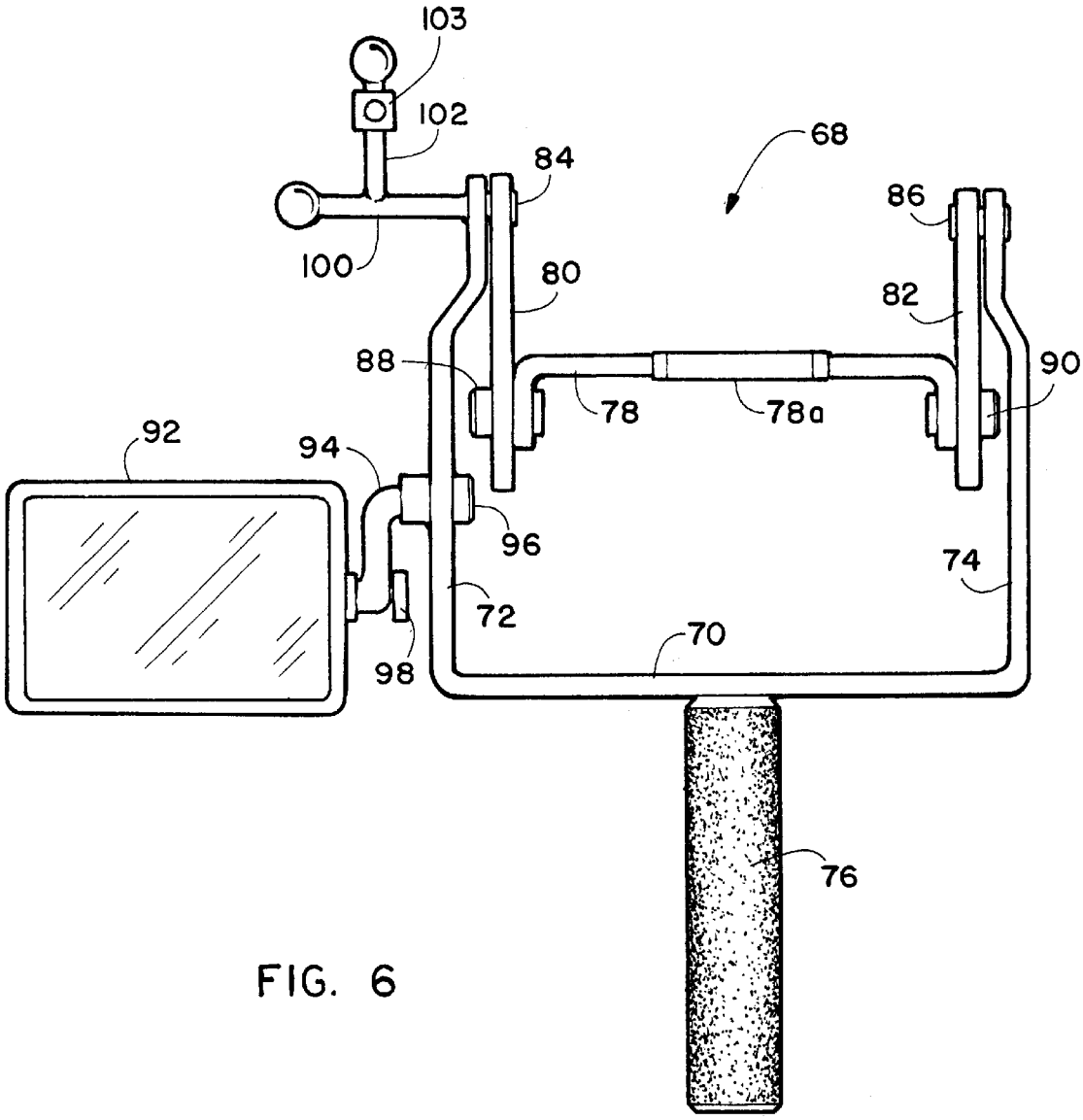
FIG. 6 is a view like FIG. 4 of another embodiment of the invention.

Illustrated in FIG. 6 is another embodiment of the invention designed to accommodate larger cameras wherein a monitoring screen is located remote from the camera. As illustrated the overall support designated generally at 68 is substantially the same in overall configuration as the prior support with a base first or outer frame having a generally U configuration with an elongated generally horizontal central bar 70, and a pair of generally laterally spaced arms 72 and 74 extending generally at a right angle to horizontal central bar 70. These arms are shown extending vertically in FIG. 6. Central bar 70 extends generally horizontally in normal operation and a handgrip 76 is secured between the ends thereof and extends downwardly. The illustrated hand grip is of a generally conventional design and for ease of gripping and holding extends downwardly and forwardly as seen in prior embodiments. The support is designed to be preferably held generally vertically as illustrated with the camera above the handgrip in normal operation. However, it may be held forward of or below the handgrip for lower angle shots.

An inner frame is formed with a horizontal bar 78 having a camera mounting platform 78*a* substantially in the center thereof and adjustably connected between a pair of links or arms 80 and 82 that are pivotally mounted at their upper ends to the upper ends of arms 72 and 74 at pivots 84 and 86. The bar 78 is attached to links 80 and 82 by thumb screws 88 and 90 extending through slots in the links. This enables the bar 78 to be raised and lowered on links 80 and 82 to adjust the position of a camera and its center of gravity relative to the pivot axes of the inner frame. This allows it to accommodate a larger camera such as a CANON GL1. The camera will use a remote monitoring screen 92, which is mounted on an arm 94 that is pivotally mounted to freely rotate on a pivot pin 96 on arm 72 of the outer frame for self leveling by gravity. A thumb screw 98 enables the angle of the monitoring screen to be adjusted relative to the arm 94. This mounting of the screen enables it to be self-leveling by gravity.

The center of gravity of the camera may be selectively adjusted relative to the pivot axis of the inner frame by raising and lowering the bar 78 in the slots in links 80 and 82. As in the prior embodiments, the camera will swing with the inner frame and remain level as the main frame is moved or pivoted fore and aft. The camera can thus, be moved from or between upper positions as shown in FIG. 4 to lower positions as shown in FIG. 5.

A control shaft 100 is connected through the pivot shaft at 84 to the inner frame to enable hand manipulation of the inner frame to tilt the camera up or down. An arm or shaft 102 is attached to shaft 100 and extends upward to mount an adjustable counterweight 103 to further adjust the center of gravity of the inner frame and camera. It also serves as a control lever for manual input into tilting the camera.

Referring to FIGS. 7, 8*a*, 8*b* and 9, a further embodiment of the invention is illustrated and designated generally by the numeral 104. This embodiment is substantially identical to FIG. 1 with the addition of a further outer frame or boom that gives the holder an additional degree of freedom within the overall support. As illustrated, with the same numbers identifying the same elements and the same number primed identifying modified elements, the second frame including members 12*a* and 12*b* is shown in an inverted position as an intermediate frame pivotally attached by a pin 106 to bracket 108 on an outer or distal end of a generally C shaped outer frame member 110. Bracket 108 is mounted on a suitable journal on the end of member 110 by a nut or stud 112 to enable it to pivot about the axis of the distal end of frame member 110. This journal is preferably sufficiently adjustable to enable the inner frame assembly to pivot without a pendulum effect. As can be seen, handle 18 has been moved from its mounting on member 12 to a similar mount on or near a proximal end of outer frame member 110.

Figure 7:
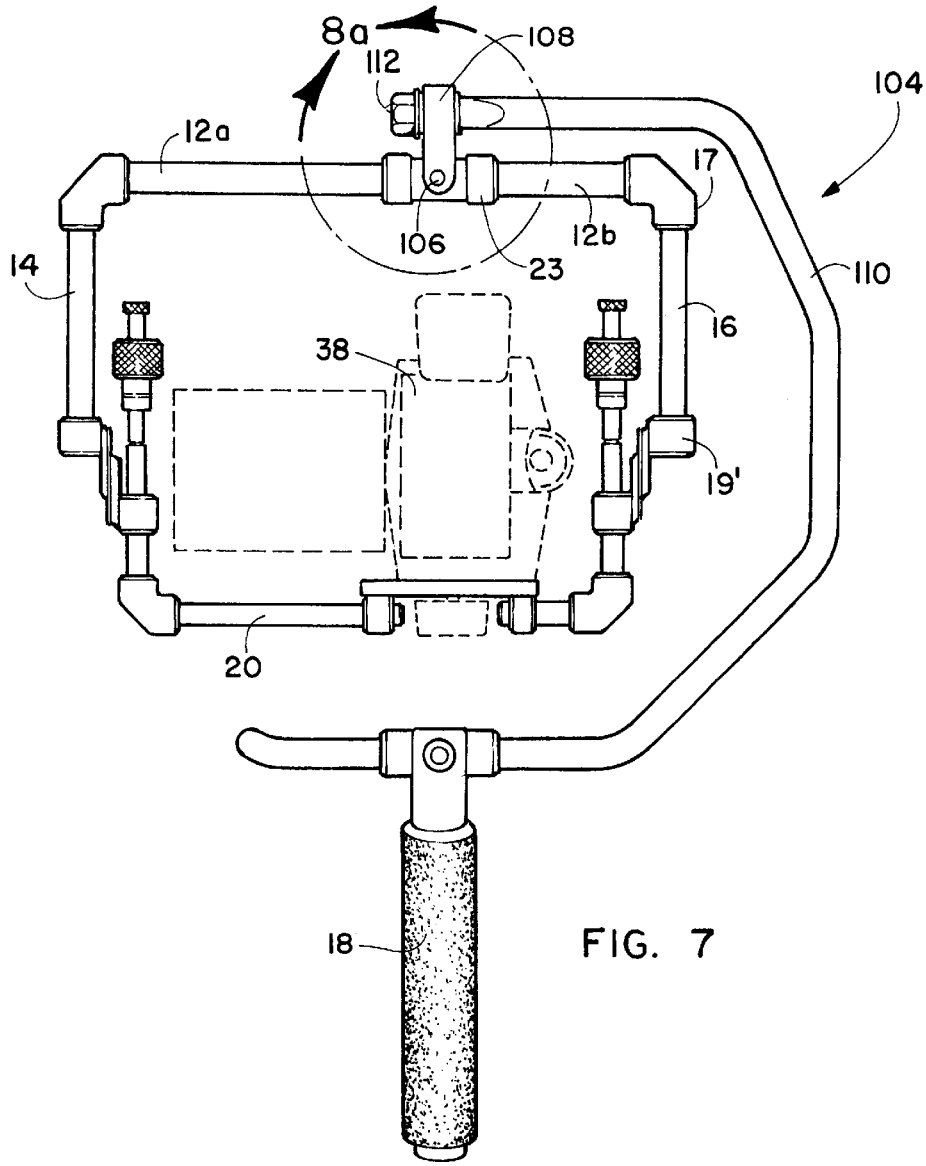
FIG. 7 is a rear elevation view of a further embodiment of the invention.
Figure 8B:
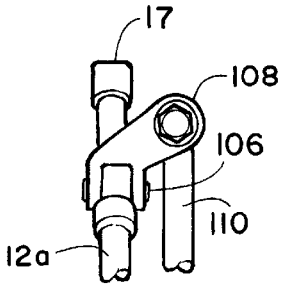
FIGS. 8*a* and 8*b* are a detail view of a portion of the embodiment of FIG. 7 with the outer support rolled to the right.
Figure 8A:
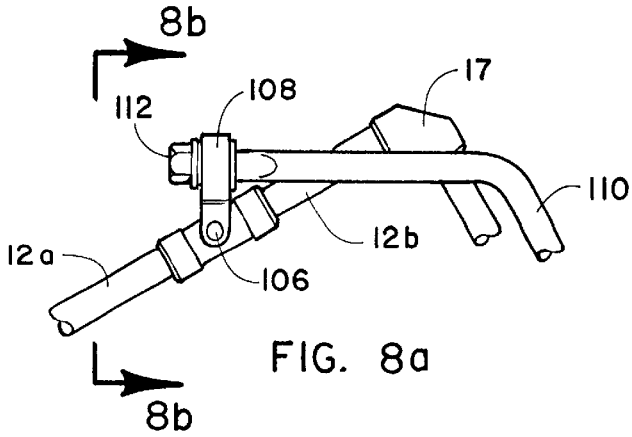

As can be seen in FIG. 7, in order to swing about pin 106 as shown in FIG. 8*a*, frame 12*b* must be offset out of the plane of outer frame 110. This can be accomplished in several ways, two of which are illustrated. FIGS. 8*a* and 8*b* illustrates a modification wherein bracket 108 is modified to support the entire combination of first and second inner frames to remain in a single plane and be offset from the plane of outer frame 110. As shown in FIG. 8*b* the bracket 108 is angled to one side from top to bottom so that intermediate frame 12*a*, 12*b* is disposed to one side of frame 110.

Figure 9:
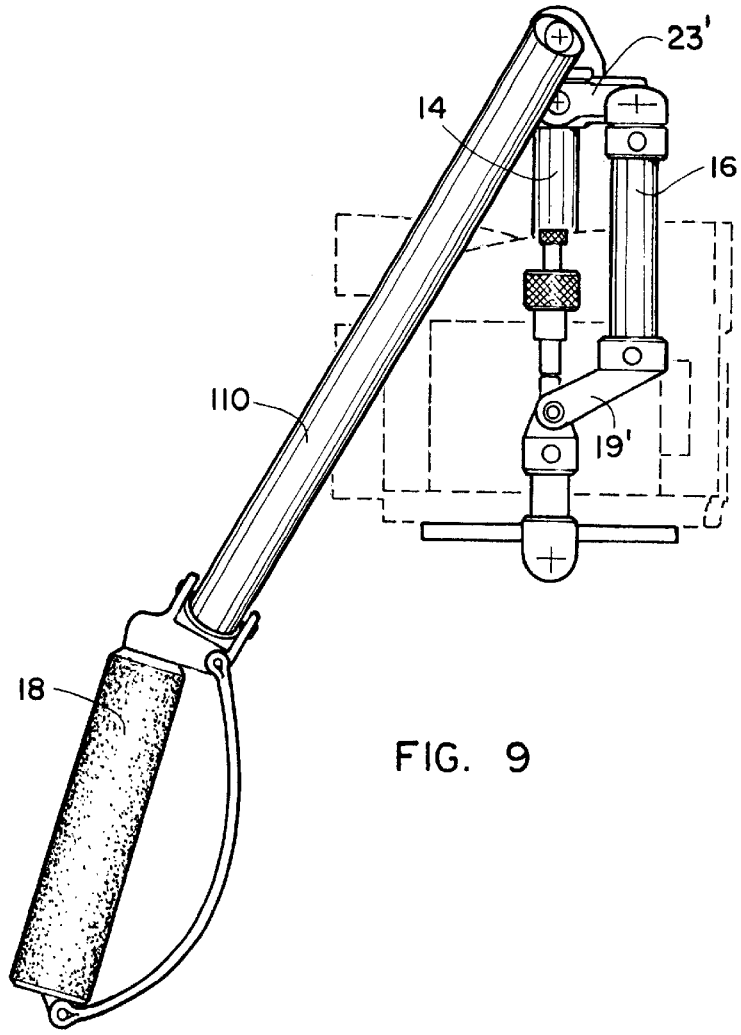
FIG. 9 is a side elevation view of the embodiment of FIG. 7.

Illustrated in FIG. 9, the right hand side (viewed in FIGS. 7 & 8*a*) of the intermediate frame has been modified to enable it to swing past frame member 110 as it pivots to the right relative to frame 110. As shown in FIG. 9, intermediate frame members 12*b* and 16 are offset or positioned forward of the remainder of the frame by modified connectors 19' and 23'. This construction enables the inner frame and camera to maintain an upright position with lateral movement or rotation relative the outer support frame. The inner frame and camera maintains an upright position directly below the pivots to the outer frame. It should also be noted that in all of the embodiments, the camera mount is constructed and configured to enable the camera to be moved fore and aft to adjust the position of the center of gravity of the camera assembly relative to the pivot axes. The outer frame can also be tilted forward and down to substantially ground level with the inner frame and camera remaining level and in the vertical orientation.

These support embodiments, as described above, provide a simple support construction that eliminates one or more component of operator movement input to the camera. This enables smoother handling and operation of video and movie cameras and eliminates many of the motions of the operator that reduces the quality of the pictures. The above described support structures may be sized or slightly modified to accommodate a wide variety and size of cameras. The support structure may also be employed with other base support structures for enhancing the range of manipulation and use. It may also by used in conjunction with other support structures for supporting and handling heavier professional or commercial cameras. The supports may also be used in combination with additional support structures such as some available under the trademark STEADICAM as well as others available.

Figure 10:
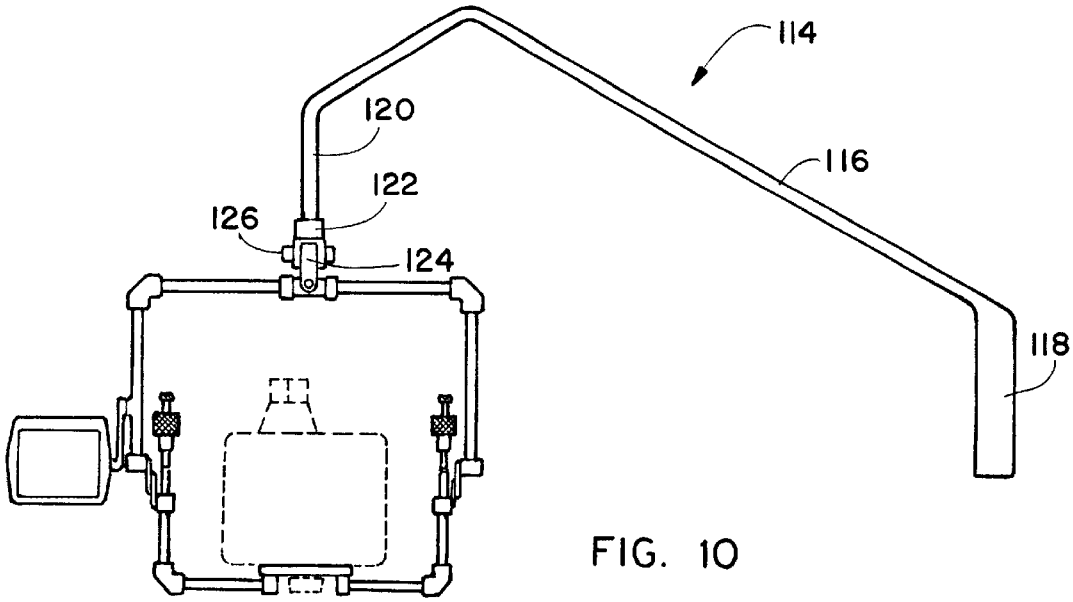
FIG. 10 is a view like FIG. 5 of a minor modification of the embodiment of FIG. 4 of the invention mounted on a boom.

Referring to FIG. 10, a pivotal arm or boom device is illustrated and designated generally at 114 that is adapted to mount on a pivot pin on a harness or device carried by the operator, an assistant, or a vehicle. The device as illustrated comprises an elongated arm or boom 116 having a vertically oriented pin socket 118 at one or a proximal end to mount on a pin on a vest or other support. A vertically oriented distal end includes a swivel bracket 122 preferably mounted to rotate about the axis of the distal end of the boom. Bracket 122 has a clevis like structure that receives and mounts a bracket 124 so that it can pivot about the axis of a pin 126. This boom structure mounts or supports a camera support structure such as those of FIGS. 1, 4, and 8.

Figure 11:
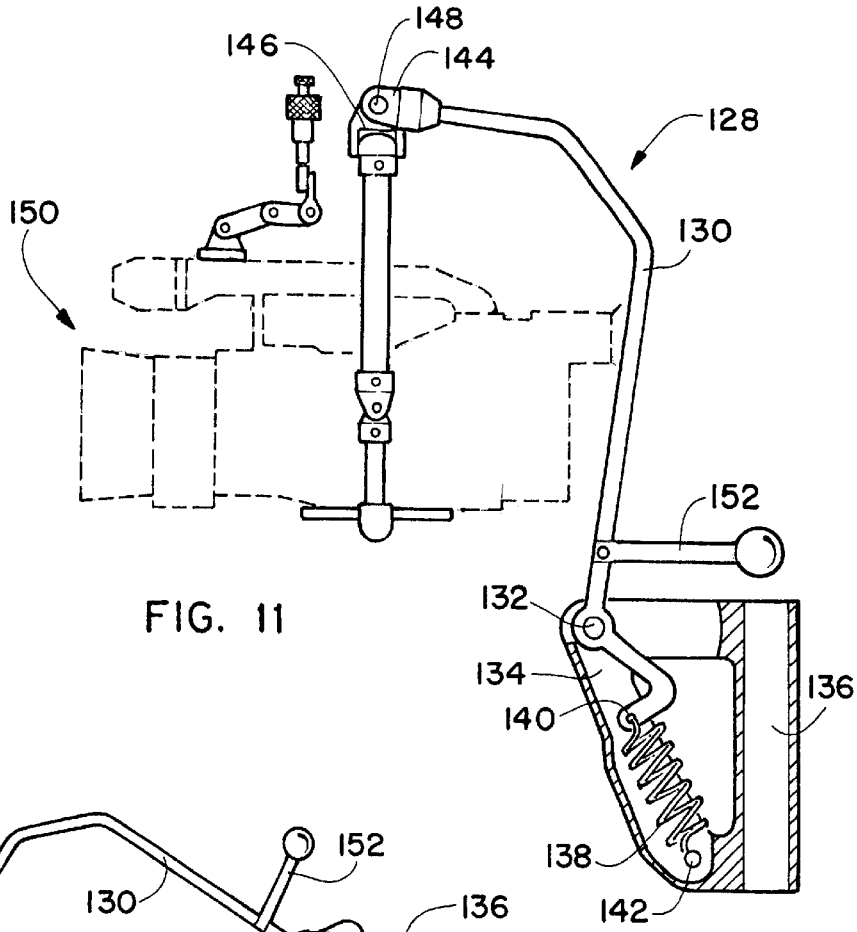
FIG. 11 is a side elevation view of a still further embodiment the invention embodying a balanced boom support.
Figure 12:
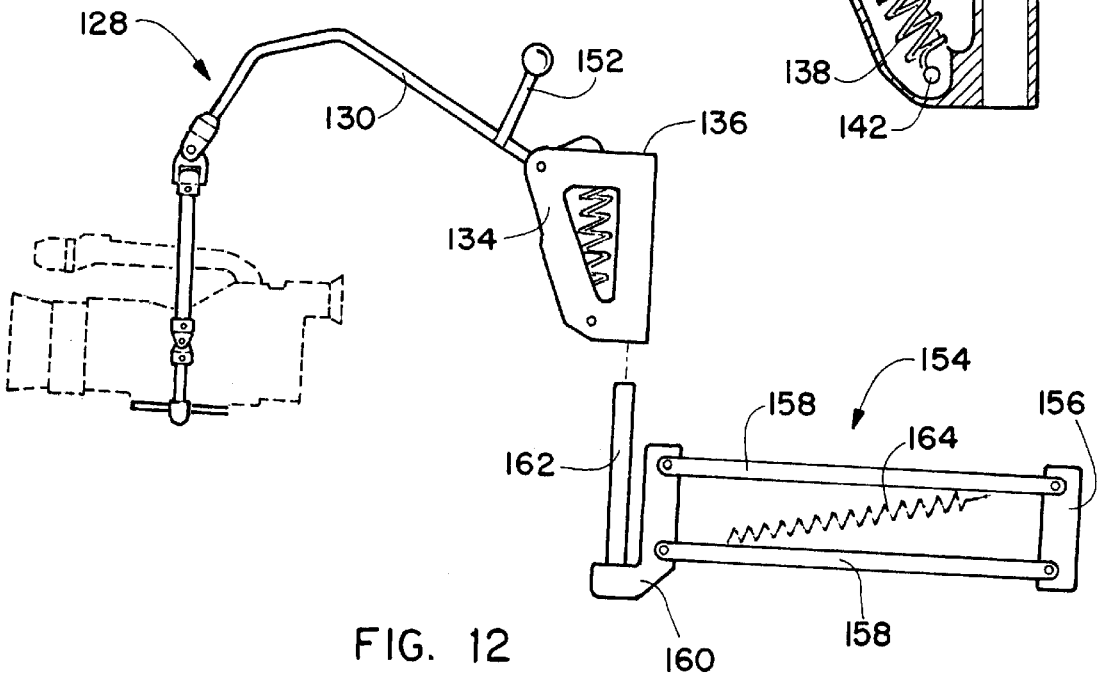
FIG. 12 in a side elevation view of the embodiment of FIG. 11 the end of a spring balanced arm support.

Referring to FIGS. 11 and 12, an alternate pivotal arm or boom device is illustrated and designated generally at 128 that is adapted to mount on a pivot pin on a harness or device carried by the operator, an assistant, or a vehicle. This device is designed to mount and support larger professional cameras that may be too large and heavy to hand carry. The device as illustrated comprises an elongated curved arm or boom 130 mounted on a pivot pin or shaft 132 at one or a proximal end to mounting bracket 134 having a vertically oriented pin socket 136 for mounting on a pin on a vest or other support. A spring 138 is connected at one end to an arm 140 on the boom and to the bracket 134 at 142 at the other end. The spring is designed to counterbalance the weight of the support and a camera on the outer end of the boom.

A distal end portion of the boom includes a portion extending normal to the main boom and including swivel bracket 144 preferably mounted to rotate about the axis of the distal end of the boom. Bracket 144 has a clevis like structure that receives and mounts a bracket 146 so that it can pivot about the axis of a pin 148 in bracket 144. This boom structure mounts or supports a camera support structure such as those of any one of FIGS. 1, 4, and 8 sized and configured to receive and mount a commercial video camera designated generally at 150. A lever 152 is secured to the boom at the proximal end of the boom near the pivot to enable an operator to raise and lower the boom to position the camera at selected vertical positions between eye level and ground level. The boom can also be swung or panned 180 degrees about a vertical pin on which bracket 134 is mounted.

Turning to FIG. 12, the apparatus of FIG. 11 is shown in an outwardly extended position and positioned to mount on a spring biased or balanced arm normally used in conjunction with a vest, which a camera operator wears with conventional professional stabilizer systems. Spring balanced arm 154 comprises a vest or vest attachment 156 having two arms 158 attached at one end thereto and at an outer end to a bracket 160. Bracket 160 has a pin 162 on which socket 136 of bracket 134 is journaled. A spring 164 is attached at a lower point on bracket 160 and an upper point on vest 156 to support the arm and a load in an outward extended position. The springed arm takes additional shock and jolting out of the camera support to provide smother pictures.

In operation, the camera support is normally held in the upright position as shown in FIG. 1. When the operator tilts the support fore or aft, the camera pivots or tilts about one or more of the pivots 26, 28, 30 or 31 and remains essentially level. Adjustment of one or more of the pivots can be used to fine-tune the support to dampen the swing of the camera as desired. The support construction also enables the support to be positioned with the grip in the upper position to allow the camera to be lowered downward below the operator's waist for lower angle shots. The support has the same stabilizing effect of eliminating the longitudinal fore and aft operator input tilt as in the FIG. 1 illustrated mode of operation.

In operation, the camera is normally held in the support upright position as shown in FIGS. 1–4, and 6–12. When the operator tilts the support fore or aft, the camera pivots or tilts about a horizontal axis of the support and remains level. The support construction also enables the support to also be positioned with the grip in the upper position as shown in FIG. 5 to allow the camera to be lowered below the operator's waist for lower angle shots. The support has the same stabilizing effect thereby eliminating the longitudinal axis fore and aft operator input tilt as in the FIG. 1 mode of operation.

While I have illustrated and described my invention by means of particular embodiments, it is to be understood that numerous changes and modifications may be made in the invention without departing from the spirit and scope of the invention, which is to be, limited only by the scope of the appended claims.

I claim:

1. A support for a camera, the support comprising: a first frame having a pair of spaced apart substantially parallel arms; a second frame having a pair of spaced apart substantially parallel arms pivotally mounted to said parallel arms of said first frame by a pivot mount to freely pivot about a pivot axis; a camera mount on said second frame adapted to detachably mount a the camera; and adjustable means for selectively adjusting a center of the combined mass of said camera and said inner frame from a position at said pivot mount to positions displaced from said pivot mount wherein said adjustable means comprises at least one adjustably positionable weight and means for detachably mounting said weight on a camera on said inner frame.

2. A support according to claim 1 wherein said adjustable means comprises means for adjustably positioning a camera relative to said pivot mount.

3. A support according to claim 1 wherein said adjustable means comprises at least one adjustably position able weight on said inner frame.

4. A support according to claim 1 wherein said adjustably position able weight comprises a base detachably mountable on a camera, an arm pivotally mounted on said base, a finger mounted on an outer end of said arm, and a weight selectively positionable along the length of said finger.

5. A support according to claim 1 wherein: said first frame has a generally U configuration with an arm at each end of a normally horizontal member; and said pivot mount is on an outer end of said arms.

6. An r support according to claim 5 further comprising a handgrip mounted on said horizontal member.

7. A support according to claim 5 wherein said second frame has a generally U configuration with an arm at each end of a normally horizontal member.

8. A support according to claim 7 wherein said adjustable means comprises means for moving each arm of said second frame relative to said pivot mount.

9. A support according to claim 8 wherein said adjustable means further comprises a weight on an extension of each arm of said second frame and means for moving each weight along said extension of each arm of said second frame relative to said pivot mount.

10. A support according to claim 7 wherein said adjustable means comprises means for moving said horizontal member along each arm of said second frame relative to said pivot mount.

11. A support for a camera, the support comprising: a first frame having generally U configuration with a pair of spaced apart substantially parallel arms, one at each end of a normally horizontal member; a second frame having a pair of spaced apart substantially parallel arms pivotally mounted to said parallel arms of said first frame by a pivot mount or an outer end of said parallel arms of said first frame to pivot about a pivot axis; a camera mount on said second frame adapted to detachably mount the camera; and adjustable means for selectively adjusting a center of the combined mass of said camera and said inner frame from a position at said pivot mount to positions displaced from said pivot mount; and an elongated third frame member having a distal end and a proximal end; a pivot connection at said distal end connected to said horizontal member of said first frame member; and support means on said proximal end for supporting said third frame for transport.

12. A support according to claim 11 wherein said third frame has a generally C configuration with an upper arm and a lower arm, said pivot mount on an outer end of said upper arm, and said support means is a handgrip mounted on said lower arm.

13. A support according to claim 12 wherein said first frame has an offset portion enabling a major portion of said first frame and said second frame to pivot substantially in a plane of said third frame.

14. A stabilizer support according to claim 11 wherein said third frame is an elongated boom having a generally L configuration and said support means is a socket at said proximal end for receiving a pivot pin.

15. A support according to claim 11 wherein said third frame is an elongated boom having a generally L configuration and said support means is a bracket at said proximal end having a socket for receiving a pivot pin, said boom pivotally mounted to said bracket for pivoting about a horizontal axis, and a spring connected between said boom and said bracket for aiding in supporting a camera mounted on said distal end of said boom.

16. A support for a camera, the support comprising: a first generally U shaped frame having a first pair of spaced apart substantially parallel arms extending normal to a first central beam; a second generally U shaped frame having a second central beam and a second pair of spaced apart substantially parallel arms extending normal to said central beam pivotally mounted to said first parallel arms of said first frame by a pivot mount to pivot about a pivot axis; a camera mount on said second central beam adapted to detachably mount a camera; and an adjustable means for moving each arm of said second frame relative to said pivot mount for selectively adjusting said second central beam to thereby adjust a center of the combined mass of said second frame and a camera on said frame from a position at said pivot axis to positions displaced from said pivot mount wherein said adjustable means further comprises a weight on an extension of each arm of said second frame and means for moving each weight along said extension of each arm of said second frame relative to said pivot mount.

17. A support according to claim 16 further comprising: an elongated third frame member having a distal end and a proximal end; a pivot connection at said distal end connected to said horizontal member of said first frame member; and support means on said proximal end for supporting said third frame for transport.

* * * * *